US008818010B2

(12) United States Patent
Inoda et al.

(10) Patent No.: US 8,818,010 B2
(45) Date of Patent: Aug. 26, 2014

(54) MICROPHONE UNIT

(75) Inventors: Takeshi Inoda, Daito (JP); Ryusuke Horibe, Daito (JP); Fuminori Tanaka, Daito (JP); Tomio Ishida, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 282 days.

(21) Appl. No.: 13/201,075

(22) PCT Filed: Jan. 20, 2010

(86) PCT No.: PCT/JP2010/050589

§ 371 (c)(1),
(2), (4) Date: Aug. 11, 2011

(87) PCT Pub. No.: WO2010/092856

PCT Pub. Date: Aug. 19, 2010

(65) Prior Publication Data

US 2011/0317863 A1 Dec. 29, 2011

(30) Foreign Application Priority Data

Feb. 13, 2009 (JP) ..... 2009-031614

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| *H04R 25/00* | (2006.01) |

(52) U.S. Cl.

CPC ..... *H04R 19/04* (2013.01)
USPC ..... 381/369; 381/361; 381/174; 381/175; 381/189

(58) Field of Classification Search

USPC ..... 381/174, 175, 361, 369, 189; 257/416, 257/778; 174/541; 361/818
See application file for complete search history.

(56) References Cited

U.S. PATENT DOCUMENTS

| | | | | |
|---|---|---|---|---|
| 2004/0173891 | A1 * | 9/2004 | Imai et al. | 257/686 |
| 2008/0037815 | A1 | 2/2008 | Ito et al. | |
| 2008/0083961 | A1 | 4/2008 | Suzuki et al. | |

(Continued)

FOREIGN PATENT DOCUMENTS

| | | | |
|---|---|---|---|
| CN | 1813490 | A | 8/2006 |
| CN | 101150888 | A | 3/2008 |

(Continued)

OTHER PUBLICATIONS

Han et al., IEEE Transactions on Components, Packaging, and Manufacturing Technology—Part A, vol. 19, No. 2, Jun. 1996.*

(Continued)

*Primary Examiner* — Matthew Eason
(74) *Attorney, Agent, or Firm* — Amster, Rothstein & Ebenstein, LLP

(57) ABSTRACT

Disclosed is a microphone unit comprising a film substrate (1), electrically conductive layers (15, 16) which are formed on both substrate surfaces of the film substrate (11), and an electrical acoustic transducer unit (12) which is provided on the film substrate (11) and comprises a diaphragm capable of converting a sound pressure to an electrical signal. In the microphone unit, the linear expansion coefficient of the film substrate (11), including the electrically conductive layers (15, 16), falls within the range of 0.8 to 2.5 times, inclusive, the linear expansion coefficient of the diaphragm.

15 Claims, 12 Drawing Sheets

(56) References Cited

U.S. PATENT DOCUMENTS

| | | | | |
|---|---|---|---|---|
| 2008/0219482 | A1 | 9/2008 | Sato | |
| 2009/0244877 | A1* | 10/2009 | Yeh et al. | 361/818 |
| 2009/0316946 | A1* | 12/2009 | Wang | 381/369 |
| 2010/0167799 | A1 | 7/2010 | Makihata et al. | |

FOREIGN PATENT DOCUMENTS

| | | | |
|---|---|---|---|
| JP | 2011153501 | A | 6/1999 |
| JP | 2000074767 | A | 3/2000 |
| JP | 2007178221 | A | 7/2007 |
| JP | 2008022332 | A | 1/2008 |
| JP | 2008047953 | A | 2/2008 |
| JP | 2008072580 | A | 3/2008 |
| JP | 2008092561 | A | 4/2008 |
| JP | 2008103612 | A | 5/2008 |
| JP | 2008136195 | A | 6/2008 |
| JP | 2008283312 | A | 11/2008 |
| JP | 2009164826 | A | 7/2009 |
| WO | 2007-007929 | A1 | 1/2007 |
| WO | 2008/077517 | A1 | 7/2008 |

OTHER PUBLICATIONS

ASM Ready Reference: Thermal Properties of Metals, 2002.*
International Search Report of PCT/JP2010/050589 dated Feb. 12, 2010.
Jun. 16, 2014 Office Action in Taiwanese Patent Application No. 099104188.

* cited by examiner

MICROPHONE UNIT

CROSS-REFERENCE TO RELATED APPLICATIONS

This application is a U.S. national stage entry under 35 U.S.C. §371 of PCT International Application No. PCT/JP2010/050589, filed on Jan. 20, 2010, and claims priority to Japanese Application No. JP 2009-031614, filed on Feb. 13, 2009, the contents of which are incorporated herein by reference in their entirety.

TECHNICAL FIELD

The present invention relates to a microphone unit that transduces a sound pressure (which occurs from a voice, for example) into an electrical signal and outputs the electrical signal.

BACKGROUND ART

Conventionally, a microphone is applied to voice input apparatuses such as voice communication apparatuses like a mobile phone, a transceiver and the like, information process apparatuses like a voice identification system and the like that use a technology for analyzing an input voice, or a record apparatus (e.g., see patent documents 1 and 2). The microphone unit has a function that transduces an input voice into an electrical signal and outputs the electrical signal.

FIG. 17 is a schematic sectional view showing a structure of a conventional microphone unit 100. As shown in FIG. 17, the conventional microphone unit 100 includes: a base board 101; an electrical acoustic transducer portion 102 that is mounted on the base board 101 and transduces a sound pressure into an electrical signal; an electrical circuit portion 103 that is mounted on the base board 101 and applies an amplification process and the like to the electrical signal obtained by the electrical acoustic transducer portion 102; and a cover 101 that protects the electrical acoustic transducer portion 102 and the electrical circuit portion 103 mounted on the base board 101 from dust and the like. The cover 104 is provided with a sound hole (through-hole) 104*a* and an external sound is guided to the electrical acoustic transducer portion 102.

Here, in the microphone unit 100 shown in FIG. 17, the electrical acoustic transducer portion 102 and the electrical circuit portion 103 are mounted by using a die bonding technology and a wire bonding technology.

In such microphone unit 100, as described in the patent document 1, it is general that the cover 104 is formed of a material that has a electromagnetic shield. function such that the electrical acoustic transducer portion 102 and the electrical circuit portion 103 are not subjected to an influence of external electromagnetic noise. Besides, as described in the patent document 2, for electromagnetic noise measures at the electrical acoustic transducer portion 102 and the electrical circuit portion 103, the base board 101 is formed of a multiple layer by means of an insulating layer and an electrically conductive layer such that the electrically conductive layer is embedded in the insulating layer, so that electromagnetic shielding is performed.

CITATION LIST

Patent Literature

PLT1: JP-A-2008-72580
PLT2: JP-A-2008-47953

SUMMARY OF INVENTION

Technical Problem

In the meantime, in recent years, electronic apparatuses are going small, and as for the microphone unit as well, size reduction and thickness reduction are desired. Because of this, it is conceivable to use a thin film base board (e.g., about 50 μm or thinner) in the thickness for the base board of the microphone unit.

However, it is found out from a study by the inventors that in a case where to achieve the thickness reduction, an electrically conductive pattern is formed on the film base board and the electrical acoustic transducer portion is formed on the pattern, a problem rises, in which sensitivity of the microphone unit becomes low. Especially, in a case where the electrically conductive layer is formed over a wide area near the electrical acoustic transducer portion, it is found out that problems easily rise, in which the sensitivity becomes low, or wrinkles occur in the diaphragm of the electrical acoustic transducer portion.

FIG. 18 is a view for describing a conventional problem in a case where the electrically conductive layer is formed on the film base board by patterning. Here, as shown in FIG. 18, the thickness of a film base board 201 is defined as x (μm); the thickness of an electrically conductive layer 202 is defined as y (μm); the coefficient of thermal expansion of the film base board 201 is defined as a (ppm/° C.); and the coefficient of thermal expansion of the electrically conductive layer 202 is defined as b (ppm/° C.). Besides, the coefficient of thermal expansion of the film base board 201 inclusive of the electrically conductive layer 202 is defined as β (ppm/° C.).

In this case, the following formula (1) is satisfied in a portion where the electrically conductive layer 202 of the film base board 201 is disposed.)

$$\beta(x+y)=ax+by \quad (1)$$

Accordingly, it is possible to express the coefficient β of thermal expansion of the film base board 210 inclusive of the electrically conductive layer 202 as the formula (2), $$\beta=(ax+by)/(x+y) \quad (2)$$

The thickness (x) of the film base board 201 is thin, so that as can be seen from the formula (2), as for the coefficient (β) of thermal expansion of the film base board 201 inclusive of the electrically conductive layer 202, the influence of the coefficient (b) of thermal expansion of the electrically conductive layer 202 becomes not-negligible. Because of this, if the electrically conductive layer is formed over a wide area of the film base board, the coefficient of thermal expansion of the film base board inclusive of the electrically conductive layer changes considerably compared with the coefficient of thermal expansion of the film base board only. Especially, if the electrically conductive layer is formed over a wide area near the electrical acoustic transducer portion of the film base board, the change becomes considerable.

In the meantime, it is possible to form the electrical acoustic transducer portion 102 of the microphone unit 100 into, for example, a MEMS (Micro Electro Mechanical System) chip that is formed of silicon. As a method for mounting this MEMS chip on the base board, there is die bonding by means of an adhesive, flip chip mounting by means of solder and the like. In a case of the flip chip mounting that uses a surface mount technology (SMT), it is possible to mount the MEMS chip on the base board 101 by a reflow process.

According to the flip chip mounting, compared with the methods like the die bonding and the wire bonding that independently perform a mount process, it is possible to produce a plurality of chips at a time, so that there is an advantageous point that the efficiency is good. In the case where the MEMS chip is mounted as described above, the MEMS chip and the electrically conductive layer (electrically conductive pattern) on the base board 101 are directly joined to each other. Because of this, if a difference between the coefficient of thermal expansion of the MEMS chip and the coefficient of thermal expansion (CTE) of the base board is large, a stress easily acts on the MEMS chip because of the influence of a temperature change during the reflow process. As a result of this, it is likely that the diaphragm of the MEMS chip bends and the sensitivity of the microphone unit deteriorates. Because of this, it is preferable that the coefficient of thermal expansion of the base board on which the MEMS chip is mounted is substantially the same as the coefficient of thermal expansion of the MEMS chip.

However, in the case where to achieve the thickness reduction, the film base board is used; the electrically conductive pattern is formed on the film base board; and the electrical acoustic transducer portion is mounted on the electrically conductive pattern, if a structure is employed in which the electrically conductive layer is disposed over a wide area especially near the electrical acoustic transducer portion, as described above, the effective coefficient of thermal expansion of the entire film base board inclusive of the electrically conductive layer changes considerably compared with the coefficient of thermal expansion of the film base board only. It is usual that the electrically conductive layer is formed of for example, a metal such as copper (whose coefficient of thermal expansion is 16.8 ppm/° C., for example) and the like and has a coefficient of thermal expansion larger than that of the silicon (whose coefficient of thermal expansion is about 3 ppm/° C.) and the like that constitute the MEMS chip. Because of this, even if the coefficient of thermal expansion of only the film base board only is matched with the coefficient of thermal expansion of the MEMS chip, the effective coefficient of thermal expansion of the entire film base board inclusive of the electrically conductive layer becomes considerably larger than the coefficient of thermal expansion of the MEMS chip. Because of this, there are problems that a remaining stress is generated in the diaphragm of the MEMS chip during the reflow process; as a result of this, the sensitivity of the microphone unit deteriorates and a desired mike characteristic is not obtained.

In light of the above points, it is an object of the present invention to provide a microphone unit that is able to effectively alleviate a stress-strain in a diaphragm, is thin, and has a high sensitivity and high performance.

Solution to Problem

To achieve the above object, a microphone unit according to the present invention is a microphone unit that includes: a film base board;

an electrically conductive layer that is formed on at least one of both base board surfaces of the film base board; and an electrical acoustic transducer portion that is mounted on the film base board, includes a diaphragm and transduces a sound pressure into an electrical signal;

wherein in at least a region near the electrical acoustic transducer portion, a coefficient of thermal expansion of the film base board inclusive of the electrically conductive layer is in a range 0.8 to 2.5 times as large as a coefficient of thermal expansion of the diaphragm.

According to the present structure, the base board of the microphone unit is the film base board, it is possible to achieve thickness reduction of the microphone unit. And, the structure of the electrically conductive layer formed on the film base board is suitably designed such that the coefficient of thermal expansion of the film base board. inclusive of the electrically conductive layer is in the range 0.8 to 2.5 times as large as the coefficient of thermal expansion of the diaphragm. Because of this, it is possible to alleviate a stress on the diaphragm, curb a tension of the diaphragm and obtain a microphone unit that has a high sensitivity and high performance.

In the microphone unit having the above structure, the microphone unit may be formed such that a coefficient a of thermal expansion of the film base board, a coefficient b of thermal expansion of the electrically conductive layer, and a coefficient c of thermal expansion of the diaphragm meet a relationship $a<c<b$, and the coefficient of thermal expansion of the film base board inclusive of the electrically conductive layer becomes substantially equal to the coefficient c of thermal expansion of the diaphragm.

According to the present structure, it is possible to make the stress acting on the diaphragm come close to 0. In other words, it is possible to make a compression direction stress from the electrically conductive pattern and a tensile-direction stress from the film base board cancel each other out, so that during a cooling time after a heating time in the reflow process, it is possible to prevent an unnecessary stress from acting on the diaphragm and make the diaphragm vibrate in a normal vibration mode. Accordingly, according to the present structure, it is possible to obtain a microphone unit that is thin, and has a high performance and high reliability.

In the microphone unit having the above structure, the coefficient a of thermal expansion of the film base board, the coefficient b of thermal expansion of the electrically conductive layer, and the coefficient c of thermal expansion of the diaphragm may meet a relationship $c \leq a<b$, and the coefficient of thermal expansion of the film base board inclusive of the electrically conductive layer may be in a range of more than 1.0 to 2.5 times as large as the coefficient of thermal expansion of the diaphragm.

According to the present structure, the structure of the electrically conductive layer on the film base board is suitably designed so that the coefficient of thermal expansion of the film base board, inclusive of the electrically conductive layer, is made to come close to the coefficient of thermal expansion of the diaphragm. Because of this, it becomes possible to prevent a twist and a local bend from occurring in the diaphragm, and make the diaphragm vibrate in the normal vibration mode; and by suitably curbing the tension of the diaphragm, it is possible to achieve a microphone that has a high performance and high reliability.

In the microphone unit having the above structure, the electrically conductive layer may be formed over a wide area of the base board surface of the film base board. According to this, it becomes possible to sufficiently secure an electromagnetic shield effect.

In the microphone unit having the above structure, the diaphragm of the electrical acoustic transducer portion may be formed of silicon. Such a diaphragm is obtained by a MEMS technique. According to this structure, it is possible to achieve a microphone unit that has a micro-size and high performance.

In the microphone unit having the above structure, the film base board may be formed of a polyimide film base material. It is preferable that a polyimide film base material whose coefficient of thermal expansion is smaller than the coefficient of silicon is used. According to this, n is possible to control such that the compression-direction stress from the electrically conductive pattern and the tensile-direction stress from the film base board cancel each other out and the stress acting on the diaphragm comes to 0. Because of this, it becomes possible to obtain a microphone unit that has an excellent heat-resistant characteristic, is thin, and has a high performance and high reliability.

In the microphone unit having the above structure, it is preferable that the electrically conductive layer is a mesh-shaped electrically conductive pattern in at least a partial region.

According to the present structure, even in the case where the electrically conductive layer is formed over a wide area, it is possible to alleviate the problem of the coefficient of thermal expansion of the film base board (inclusive of the electrically conductive layer) considerably deviating from the coefficient of thermal expansion of the film base board alone. Besides, it is possible to form the electrically conductive layer over a wide area, so that it is possible to increase the electromagnetic shield effect. And, the coefficient of thermal expansion of the film base board, inclusive of the electrically conductive layer, has a value close to the coefficient of thermal expansion of the electrical acoustic transducer portion, so that it is possible to alleviate an unnecessary remaining stress acting on the electrical acoustic transducer portion during the heating and cooling steps in the reflow process, and the like.

Besides, in the microphone unit having the structure in which the mesh-shaped electrically conductive pattern is formed on both surfaces of the film base board, the mesh-shaped electrically conductive pattern formed on one surface and the mesh-shaped electrically conductive pattern formed on the other surface may be deviated from each other in a positional relationship.

According to the present structure, it is possible to substantially narrow the distance (pitch) between meshes while forming the mesh-shaped electrically conductive pattern over a wide area of the film base board. Because of this, it is possible to increase the electromagnetic shield effect.

In the microphone unit having the above structure, the mesh-shaped electrically conductive pattern may be a wiring pattern for a ground connection. According to this, it is possible to employ a structure in which the mesh-shaped electrically conductive pattern has both a ground (GND) wiring function and an electromagnetic shield function.

In the microphone unit having the above structure, the electrical acoustic transducer portion may be disposed on the film base hoard by flip chip mounting. In the case where the electrical acoustic transducer portion is disposed on the film base board by flip chip mounting, especially a difference between the coefficient of thermal expansion of the film base board and the coefficient of thermal expansion of the electrical acoustic transducer portion easily brings a considerable influence onto the performance of the microphone unit. Because of this, the present structure is effective.

In the microphone unit having the above structure, the electrical acoustic transducer portion and the electrically conductive layer may be joined to each other at a plurality of points that have distances that are equal to each other from a center of the diaphragm. And, in this structure, the electrical acoustic transducer portion may be formed into substantially a rectangular shape when viewed from top, while the plurality of junction portions may be formed at four corners of the electrical acoustic transducer portion. According to this structure, it is easy to reduce the remaining stress acting on the electrical acoustic transducer portion.

In the microphone unit having the above structure, the mesh-shaped electrically conductive pattern and the electrical acoustic transducer portion may be so disposed as not to overlap with each other when viewed from top. According to this structure, it is possible to reduce the remaining stress acting on the electrical acoustic transducer portion.

Advantageous Effects of Invention

According to the present invention, it is possible to provide a microphone unit that is able to effectively alleviate a stress-strain in a diaphragm, is thin, and has a high sensitivity and high performance.

DESCRIPTION OF EMBODIMENTS

Hereinafter, an embodiment of a microphone unit to which the present invention is applied is described in detail with reference to drawings.

Figure 1:
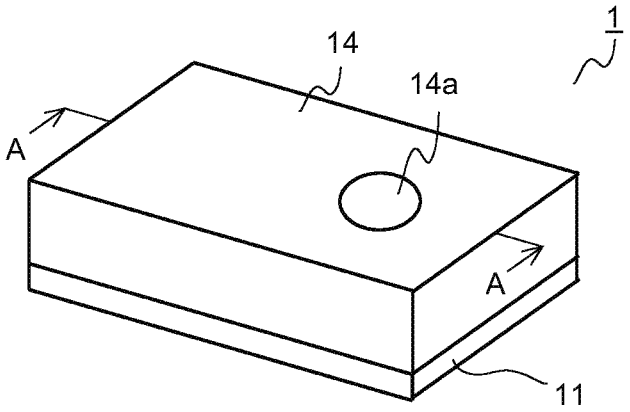
FIG. 1 is a schematic perspective view showing a structure of a microphone unit according to an embodiment.
Figure 2:
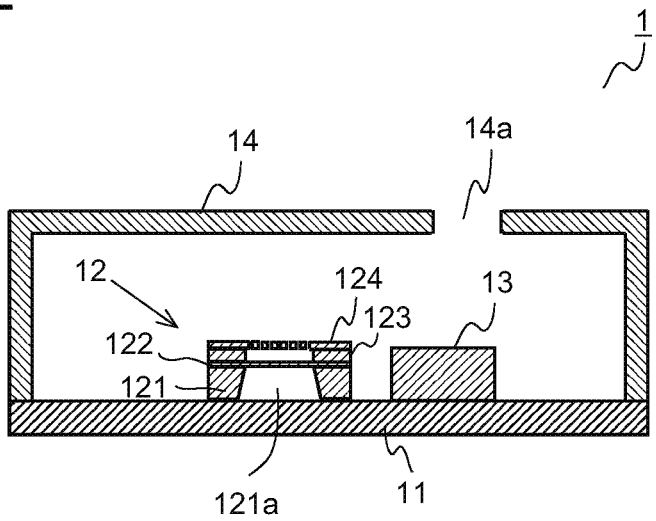
FIG. 2 is a schematic sectional view along an A-A position in FIG. 1.

FIG. 1 is a schematic perspective view showing a structure of a microphone unit according to the present embodiment. FIG. 2 is a schematic sectional view along an A-A position in FIG. 1. As shown in FIG. 1 and FIG. 2, a microphone unit 1 according to the present embodiment includes: a film base board 11; a MEMS (Micro Electro Mechanical System) chip 12; an ASIC (Application Specific Integrated Circuit) 13; and a shield cover 14.

The film base board 11 is formed of for example, an insulation material such as polyimide and the like; and has a thickness of about 50 μm. Here, the thickness of the film base board 11 is not limited to this; and may be suitably changed to be thinner than 50 μm, for example. Besides, the film base board 11 is formed such that a difference between the coefficient of thermal expansion of the film base board 11 and the coefficient of thermal expansion of the MEMS chip 12 becomes small. Specifically, because a structure is employed in which the MEMS chip 12 is formed of a silicon chip, to make the coefficient of thermal expansion of the film base board 11 conic close to the coefficient of thermal expansion of the silicon (2.8 ppm/° C.), the film base board 11 is so designed as to have a coefficient of thermal expansion that is equal to or larger than, for example, 0 ppm/° C. and less than or equal to 5 ppm/° C.

Here, as the film base board that has the above-described coefficient of thermal expansion, it is possible to use, for example, XENOMAX (registered trademark; the coefficient of thermal expansion is 0 to 3 ppm/° C.) from TOYOBO CO., LTD. and POMIRAN (registered trademark; the coefficient of thermal expansion is 4 to 5 ppm/° C.) from ARAKAWA CHEMICAL INDUSTRIES, LTD., and the like. Besides, the reason for making the difference between the coefficient of thermal expansion of the film base board 11 and the coefficient of thermal expansion of the MEMS chip 12 small is to minimize an unnecessary stress that occurs on the MEMS chip 12 (in more detail, a later-described diaphragm of the MEMS chip 12) due to the difference between both coefficients of thermal expansion during the reflow process.

On the film base board 11, the MEMS chip 12 and the ASIC 13 are mounted so that an electrically conductive layer (which is not shown in FIG. 1 and FIG. 2) is formed for a purpose of forming a circuit wiring and for a purpose of obtaining an electromagnetic shield function. Details of this electrically conductive layer are described later.

The MEMS chip 12 is an embodiment of an electrical acoustic transducer portion that includes a diaphragm to transduce a sound pressure into an electrical signal. As described above, in the present embodiment, the MEMS chip 12 is formed of silicon. The MEMS chip 12, as shown in FIG. 2, includes: an insulating base board 121; a diaphragm 122; an insulating layer 123; and a stationary electrode 124; and is formed into a capacitor-type microphone.

The base board 121 is provided with an opening 121*a* that has substantially a circular shape when viewed from top. The diaphragm 122 formed on the base board 121 is a thin film, which receives a sound wave to vibrate (vibrate vertically), has electrical conductivity and thrills one end of an electrode. The stationary electrode 124 is so disposed as to face the diaphragm 122 with the insulating layer 123 interposed. According to this, the diaphragm 122 and the stationary electrode 124 form a capacitance. Here, the stationary electrode 124 is provided with a plurality of sound holes such that a sound wave is able to pass through it, so that a sound wave coming from an upper side of the diaphragm 122 reaches the diaphragm 122.

If a sound pressure acts on an upper surface of the diaphragm 122, the diaphragm 122 vibrates, so that the distance between the diaphragm 122 and the stationary electrode 124 changes; and the electrostatic capacitance between the diaphragm 122 and the stationary electrode 124 changes. Because of this, by means of the MEMS chip 12, it is possible to transduce the sound wave into an electrical signal and draw out the electrical signal.

Here, the structure of the MEMS chip as the electrical acoustic transducer portion is not limited to the structure according to the present embodiment. For example, in the present embodiment, the diaphragm 122 is under the stationary electrode 124; however, a structure may be employed such that a reverse relationship is obtained (i.e., the diaphragm 122 is over the stationary electrode 124).

The ASIC 13 is an integrated circuit that applies an amplification process to the electrical signal that is drawn out based on a change of the electrostatic capacitance of the MEMS chip 12. The ASIC 13 may be so structured as to include a charge pump circuit and an operational amplifier such that the change of the electrostatic capacitance of the MEMS chip 12 is accurately obtained. The electrical signal amplified by the ASIC 13 is output to outside of the microphone unit 1 via the mount base board where microphone unit 1 is mounted.

The shield cover 14 is disposed such that the MEMS chip 12 and the ASIC 13 are not subjected to an influence of electromagnetic noise from outside; and further, the MEMS chip 12 and the ASIC 13 are not subjected to an influence of dust and the like. The shield cover 14 is a box-shaped body that has substantially a cuboid-shaped space, so disposed as to cover the MEMS chip 12 and the ASIC 13, and joined to the film base board 11. It is possible to join the shield cover 14 and the film base board 11 by using, for example, an adhesive, solder, and the like.

A top plate of the shield cover 14 is provided with a through-hole 14*a* that has substantially a circular shape when viewed from top. By means of this through-hole 14*a*, it is possible to guide a sound, which occurs in the outside of the microphone unit 1, to the diaphragm 122 of the MEMS chip 12. In other words, the through-hole 14*a* functions as a sound hole. The shape of this through-hole 14*a* is not limited to the structure according to the present embodiment, and is able to be suitably changed.

Figure 3A:
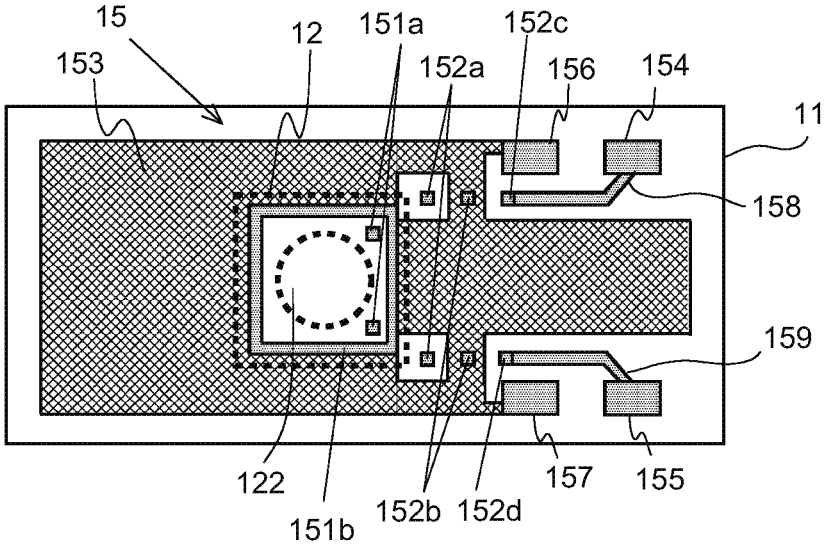
FIG. 3A is a view for describing a structure of an electrically conductive layer formed on a film base board of a microphone unit according to the present embodiment, that is, a plan view when viewing the film base board from the top.
Figure 3B:
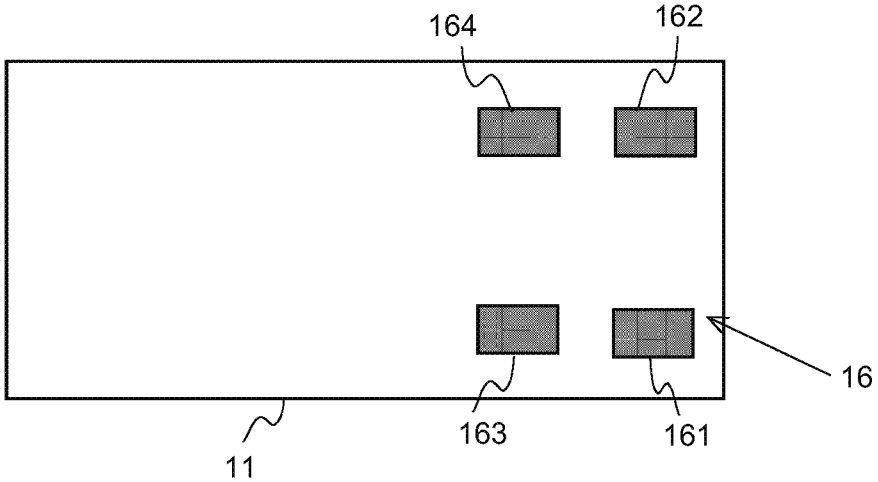
FIG. 3B is a view for describing a structure of an electrically conductive layer formed on a film base board of a microphone unit according to the present embodiment, that is, a plan view when viewing the film base board from the bottom.

Next, details of the electrically conductive layer formed on the film base board 11 are described with reference to FIGS. 3A and 3B. FIG. 3A and FIG. 3B are views for describing a structure of the electrically conductive layer formed on the film base board of the microphone unit according to the present embodiment, of which FIG. 3A is a plan view when viewing the film base board 11 from top; FIG. 3B is a plan view when viewing the film base board 11 from bottom. As shown in FIG. 3A and FIG. 3B, on both base board surfaces (upper surface and lower surface) of the film base board 11, electrically conductive layers 15, 16 composed of, for example, a metal such as copper, nickel, an alloy of these metals and the like are formed.

Here, in FIG. 3A, for a purpose of facilitating the understanding, the MEMS chip 12 (which is so formed as to have substantially a rectangular shape when viewed from top) also is represented by a broken line. Especially, a circular-shape broken line represents a vibration portion of the diaphragm 122 of the MEMS chip 12.

The electrically conductive layer 15 formed on the upper surface of the film base board 11 includes: an output pad 151*a* for drawing out the electrical signal that is generated by the MEMS chip 12; and a junction pad 151*b* for joining the MEMS chip 12 to the film base board 11. In the present embodiment, the MEMS chip 12 is disposed by flip chip mounting. In the flip chip mounting, solder paste is transferred to the output pad 151*a* and the junction pad 151*b* on the film base board by using screen printing and the like; on the solder paste, a not-shown electrode terminal formed on the MEMS chip 12 is so disposed as to face the solder paste. And, by performing reflow process, the output pad 151*a* is electrically joined to a not-shown electrode pad formed on the MEMS chip 12. The output pad 151*a* is connected to a not-shown wiring formed in the inside of the film base hoard 11.

The junction pad 151*b* is formed into a frame shape; the reason for employing such a structure is as follows. If the junction pad 151*b* is formed into a frame shape, in a state where the MEMS chip 12 is disposed on the film base board 11 by the flip chip mounting (e.g., a state of being joined by solder), it becomes possible to prevent a sound from leaking into the opening portion 121*a* (see FIG. 2) from the lower surface of the MEMS chip 12. In other words, to obtain a sound leak prevention function, the junction pad 151*b* is formed into the frame shape.

Besides, this junction pad 151*b* is directly electrically connected to a GND (ground; as described later, this is a mesh-shaped electrically conductive pattern 153) of the film base board 11; and has a role as well in connecting a GND of the MEMS chip 12 to the GND of the film base board 11.

Figure 4A:
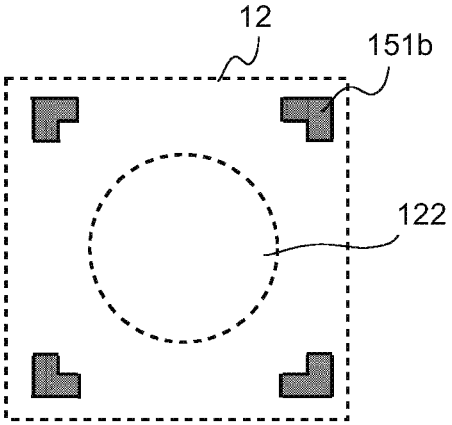
FIG. 4A is a view showing a first alternative example of a stricture of a junction portion that joins and fixes a MEMS chip to a film base board.
Figure 4B:
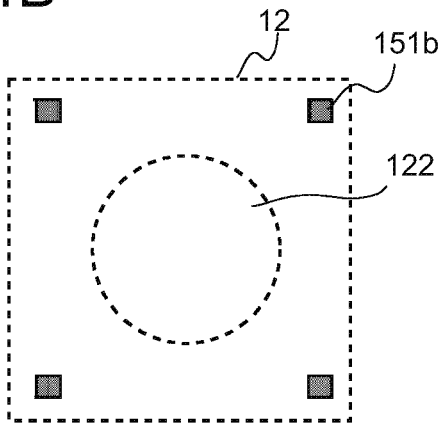
FIG. 4B is a view showing a second alternative example of a structure of a junction portion that joins and fixes a MEMS chip to a film base board.

Here, in the present embodiment, the structure is employed in which the junction pad (junction portion) 151*b* for joining and fixing the MEMS chip 12 to the film base board 11 is formed into the continuous frame shape; however, this shape is not limiting. For example, the junction pad 151*b* may have structures and the like as shown in FIG. 4A, FIG. 4B. FIG. 4A is a view showing a first alternative example of the structure of the junction portion that joins and fixes the MEMS chip to the film base board; FIG. 4B is a view showing a second another example of the structure of the junction portion that joins and fixes the MEMS chip to the film base board.

In the first another example, a plurality of the junction pads 151*b* are independently disposed at positions that correspond to four corners of the MEMS chip 12. The shape of the junction pad 151*b* having this structure is not especially limiting, and it is possible to employ substantially an L shape when viewed from top.

Besides, in the second alternative example, a structure is employed, in which of the frame-shape junction pad 151*b* (see FIG. 3) in the present embodiment, the four corners are left as the junction pads 151*b* (a structure in which a total of four junction pads 151*b* are disposed). In both of the first and second alternative examples, it is a feature that the junction and fixing are performed at the plurality of points that have distances equal to each other from a center of the diaphragm 122.

Compared with the case where the continuous frame-shape junction pad 151*b* (see FIG. 3) is employed, as shown the present embodiment, in the case where the plurality of junction pads 151*b* are independently employed, as shown in the first and second alternative examples, it is possible to reduce a remaining stress that acts on the MEMS chip 12 (especially, on the diaphragm 122) because of heating and cooling during the reflow process. And, it is possible to even out the stress that acts on the diaphragm 122 and make the diaphragm 122 vibrate in a normal vibration mode. It is also possible to obtain a microphone unit that has a high performance and high reliability.

Because of this, for the purpose of reducing the stress that acts on the MEMS chip 12 because of the heating and cooling during the reflow process, as in the above first and second alternative examples, it is preferable that the plurality of junction pads are substantially symmetrically disposed on the film base board 11 with respect to the central portion of the diaphragm 122; and the MEMS chip 12 is joined to the film base board 11. And, for the purpose of reducing the above remaining stress, it is preferable that the distance from the diaphragm 122 to the junction pad 151*b* is as long as possible; and as shown in FIG. 4A and FIG. 4B, the junction is performed at the four corners of the MEMS chip 12. According to this, it is possible to reduce the remaining stress acting on the diaphragm 122 and effectively alleviate sensitivity deterioration of the microphone unit 1.

Here, as in the first alternative example and the second alternative example, in the case of the structure in which the plurality of junction pads are employed, the above sound leak prevention function is not obtained; however, it is sufficient to additionally dispose a seal member as necessary. Besides, the above description about the junction pad 151*b* applies not only to the case where the film base board is used for the microphone unit, but also to the case where an inexpensive rigid base board, such as a glass epoxy base board (e.g., FR-4) and the like, is used.

Besides, in a case where the continuous junction pad 151*b* is indispensable for the prevention of sound leakage, by forming the junction pad 151*b* and the diaphragm 122 into substantially the same shape, it is possible to even out the stress that acts on the diaphragm 122. For example, in a case where the diaphragm has a circular shape, it is preferable that the junction pad 151*b* is formed into a circular shape that is concentric with the diaphragm. In a case where the diaphragm has a rectangular shape, it is preferable that the junction pad also is formed into a similar rectangular shape.

Back to FIG. 3A, the electrically conductive layer 15 formed on the upper surface of the film base board 11 includes: an input pad 152*a* for inputting the signal from the MEMS chip 12 into the ASIC 13; a GND connection pad 152*b* for connecting the GND of the ASIC 13 to the GND 153 of the film base hoard 11; a power-supply electricity input pad 152*c* for inputting power-supply electricity into the ASIC 13; and an output pad 152*d* for outputting the signal processed by the ASIC 13. Theses pads 152*a* to 152*d* are electrically connected, by the flip chip mounting, to electrode pads formed on the ASIC 13.

The input pad 152*a* is connected to a wiring (not shown) formed in the inside of the film base board 11, and is electrically connected to the above output pad 151*a*. According to this, transmission and reception of the signal are possible between the MEMS chip 12 and the ASIC 13.

Here, in the present embodiment, the structure is employed in which, by means of the wiring formed in the inside of the film base board 11, the output pad 151*a* and the input pad 152*a* are electrically connected to each other; however, this structure is not limiting. For example, by means of a wiring formed on the lower surface of the film base board 11, both pads may be connected to each other. In the cases where the junction pad 151*b* is structured as shown in FIG. 4A and FIG. 4B, for example, it is possible to connect both pads to each other by means of a wiring formed on the upper surface of the film base hoard 11.

On the film base board 11, the electrically conductive pattern 153 (details are described later) is formed over a wide area that includes a right-under portion where the MEMS chip 12 is mounted. In the case where the electrically conductive pattern (electrically conductive layer) is formed over a wide area of the film base board, as in the microphone unit according to the present embodiment, when considering a stress-strain in the diaphragm 122, it is necessary to think of the coefficient of thermal expansion of the film base board inclusive of the electrically conductive layer. This is described in detail hereinafter with reference to FIG. 5 to FIG. 11.

Figure 5A:
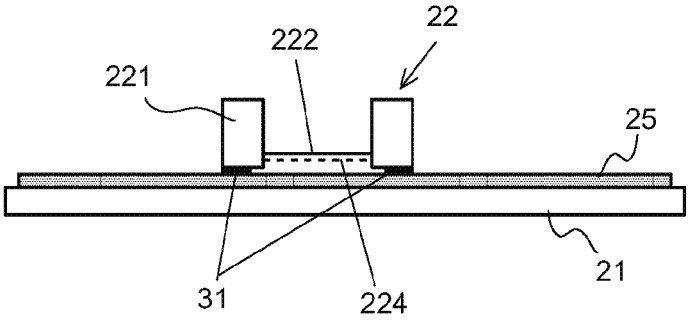
FIG. 5A is a sectional model view for describing a coefficient of thermal expansion of a film base board, inclusive of an electrically conductive layer.
Figure 5B:
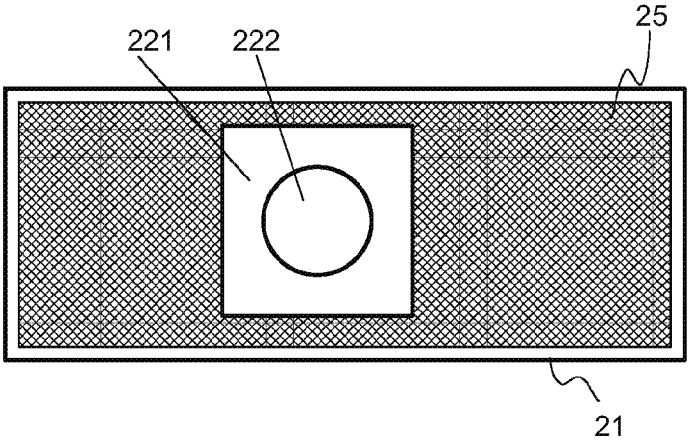
FIG. 5B is a top model view for describing a coefficient of thermal expansion of a film base board, inclusive of an electrically conductive layer.

FIG. 5A and FIG. 5B are model views for describing the coefficient of thermal expansion of the film base board inclusive of the electrically conductive layer, of which FIG. 5A is a schematic sectional view and FIG. 5B is a schematic plan view when viewed from top. A case is examined where, as shown in FIG. 5A and FIG. 5B, an electrically conductive pattern (electrically conductive layer) 25 is formed on a film base board 21 and an electrical acoustic transducer portion 22 is joined onto the electrically conductive pattern 25. The electrical acoustic transducer portion 22 is so structured as to include; a diaphragm 222; a base board 221 that holds the diaphragm 222; and a stationary electrode 224. In the case of this model, it is necessary to consider three points, chiefly: i) the coefficient of thermal expansion of the film base board 21; ii) the coefficient of thermal expansion of the electrically conductive pattern 25; and iii) the coefficient of thermal expansion of the diaphragm 222.

In the case where the diaphragm 222 is formed of silicon by using MEMS (micro-electro-mechanical systems) technology, the coefficient of thermal expansion of the diaphragm 222 becomes 2.8 ppm/° C., for example. Generally, a metal material is used for the electrically conductive pattern 25 on the film base board 21; the coefficient of thermal expansion is distributed near 10 to 20 ppm/° C., and becomes larger than the coefficient of thermal expansion of the silicon. In the case where copper is used for the electrically conductive pattern 25, for example, the coefficient of thermal expansion is 16.8 ppm/° C.

As for the film base board 21, in light of resistance to solder reflow, a heat-resistant film, such as polyimide and the like, is often used. The coefficient of thermal expansion of usual polyimide is 10 to 40 ppm/° C.; and the value changes depending on the structure and composition. Recently, polyimide films having low coefficients of thermal expansion have been developed: a polyimide film (registered trademark POMIRAN, ARAKAWA CHEMICAL INDUSTRIES, LTD., 4 to 5 ppm/° C.) having a value for the coefficient of thermal expansion that is close to the value of silicon, and polyimide film (registered trademark XENOMAX, TOYOBO CO., LTD., 0 to 3 ppm/° C.) having a value for the coefficient of thermal expansion that is smaller than the value of silicon.

Here, a case is examined where the coefficient of thermal expansion of the film base board 21 is smaller than the coefficient of thermal expansion of the diaphragm 222; in other words, the following relationship is satisfied: the coefficient of thermal expansion of the film base board<the coefficient of thermal expansion of the diaphragm<the coefficient of thermal expansion of the electrically conductive pattern.

Figure 6:
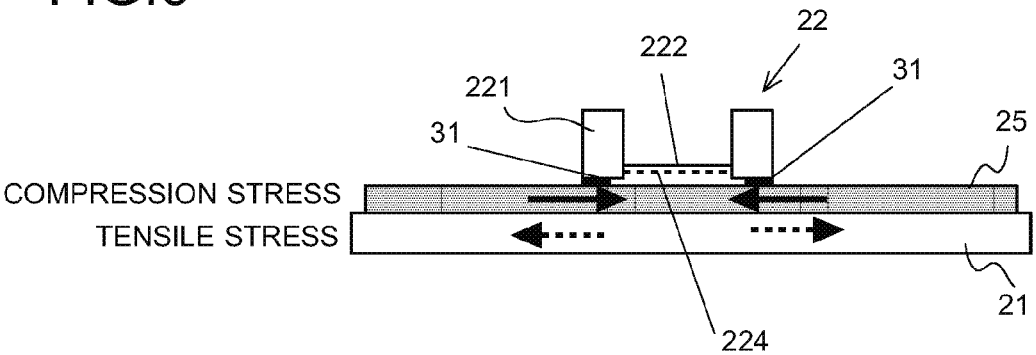
FIG. 6 is a view for describing a stress acting on a diaphragm of a MEMS chip in a case where, in the models shown in FIG. 5A and FIG. 5B, the coefficient of thermal expansion of the film base board is smaller than the coefficient of thermal expansion of the diaphragm.

To dispose the electrical acoustic transducer portion 22 onto the electrically conductive pattern 25 on the film base board 21 by flip chip mounting, solder paste is transferred to the electrically conductive pattern 25, to which the electrical acoustic transducer portion 22 is to be joined, by using a technique such as screen printing and the like; the electrical acoustic transducer portion 22 is mounted, and the film base board 21 on which the electrical acoustic transducer portion 22 is mounted undergoes the reflow process. In this case, during the cooling time after the heating time, the solder 31 sets near the solder melting point, so that a positional relationship between the electrical acoustic transducer portion 22 and the electrically conductive pattern 25 is decided. When the solder 31 is in a melting state before setting, a stress does not act on the diaphragm 222. However, after the set during the cooling step, the electrically conductive pattern 25 is larger than the diaphragm 222 in shrink amount while the film base board 21 is smaller than the diaphragm 222 in shrink amount. Because of this, which is caused by the difference in the coefficients of thermal expansion, as shown in FIG. 6, a compression-direction stress on the diaphragm 222 occurs in the electrically conductive pattern 25, while in the film base board 21, a tensile-direction stress on the diaphragm 222 occurs. The larger the difference between the solder melting point and the room temperature is, the larger this stress becomes.

Here, FIG. 6 is a view for describing the stress acting on the diaphragm of the MEMS chip in a case where, in the models shown in FIG. 5A and FIG. 5B, the coefficient of thermal expansion of the film base board is smaller than the coefficient of thermal expansion of the diaphragm.

Figure 7:
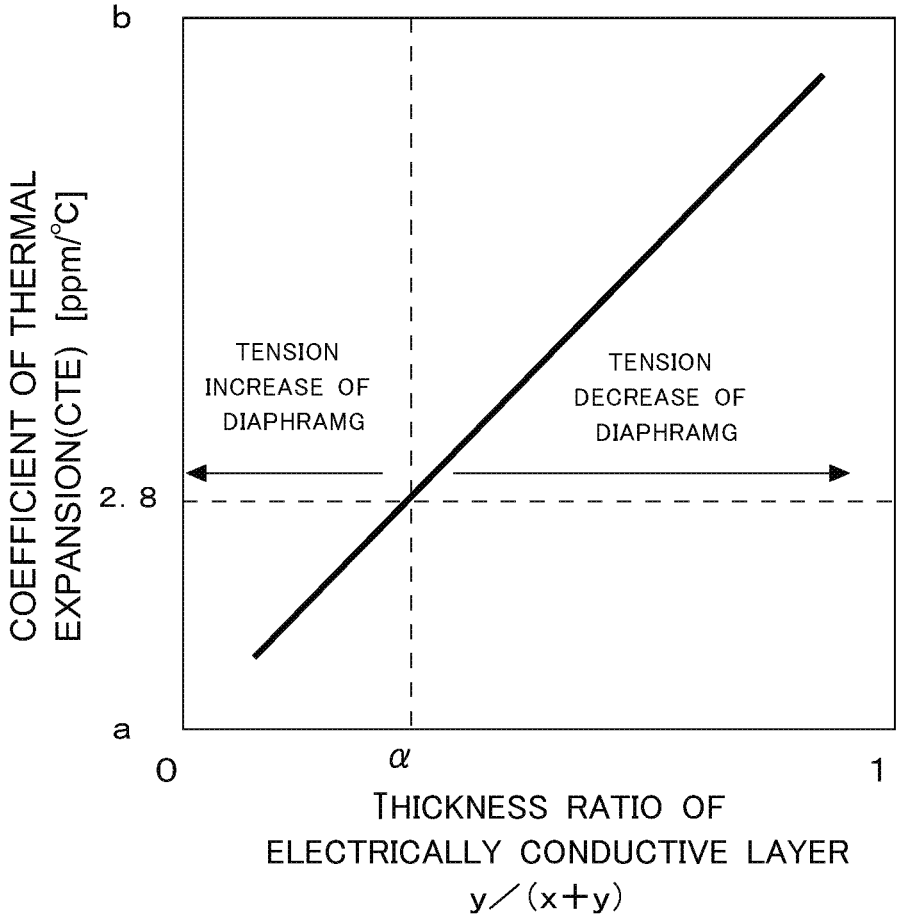
FIG. 7 is a graph showing a characteristic of a coefficient of thermal expansion of a film base board, inclusive of a conductor pattern.

Here, a case is examined where the film base board 21 on which the electrically conductive pattern 25 is formed has a two-layer laminate structure. The thickness of the film base board 21 is x, and the coefficient of thermal expansion of the film base board 21 is a. The thickness of the conductor pattern 25 is y, and the coefficient of thermal expansion of the conductor pattern 25 is b. The characteristic of the coefficient of thermal expansion of the film base board 21, inclusive of the conductor pattern 25, versus the thickness of the conductor pattern 15 is as shown in FIG. 7. A horizontal axis in FIG. 7 represents the thickness ratio (y/(x+y)) of the conductor layer (electrically conductive pattern) to the total thickness of the two-layer structure. The vertical axis represents the coefficient of thermal expansion of the two-layer structure.

In FIG. 7, it is represented that the coefficient of thermal expansion of the film base board 21 inclusive of the conductor pattern 25 changes in accordance with the thickness ratio between the conductor pattern 25 and the film base board 21. When the thickness ratio of the conductor pattern 25 is 0, the coefficient of thermal expansion=a; and when the thickness ratio of the conductor pattern 25 is 1, the coefficient of thermal expansion=b. Besides, on the vertical axis, the coefficient of thermal expansion of silicon (2.8 ppm/° C.) is represented. From this figure, it is understood that if a relationship $a<2.8<b$ is satisfied, by setting the thickness ratio of the conductor pattern 25 at $\alpha$, it is possible to match the coefficient of thermal expansion of the film base board 21, inclusive of the conductor pattern 25, with the coefficient of thermal expansion of the silicon.

Figure 8:
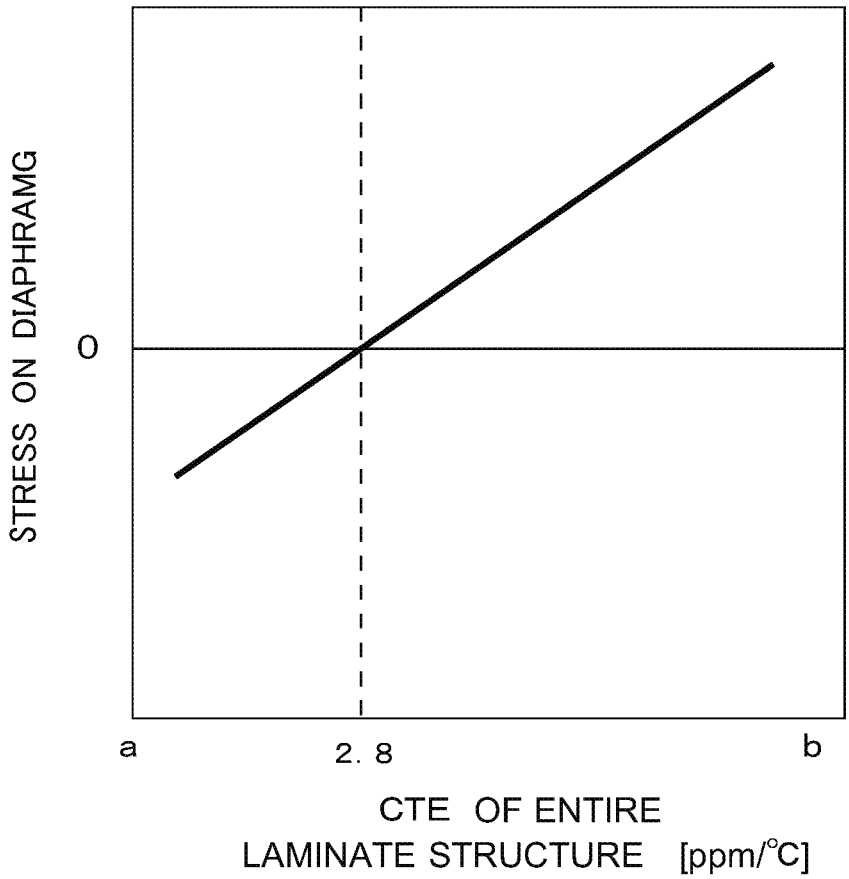
FIG. 8 is a graph showing a relationship between a coefficient of thermal expansion of a film base board, inclusive of a conductor pattern, and a stress on a diaphragm.

FIG. 8 is a graph showing a relationship between the coefficient of thermal expansion (CTE) of the entire laminate structure of the film base board 21, inclusive of the conductor pattern 25, and the stress on the diaphragm 222. By suitably setting the thickness ratio of the electrically conductive pattern 25 and matching the coefficient of thermal expansion of the film base board 21, inclusive of the conductor pattern 25, with the coefficient of thermal expansion of the silicon, it is possible to make the stress acting on the diaphragm 222 come close to 0. In other words, it is possible to make the compression-direction stress from the conductor pattern 25 and the tensile-direction stress from the film base board 21 cancel each other out, so that it is possible to prevent an unnecessary stress from acting on the diaphragm 222 during the cooling time after the heating time in the reflow process. According to this, it becomes possible to make the diaphragm 222 vibrate in the normal vibration mode, and it is possible to achieve a microphone that has a high performance and high reliability.

Figure 9:
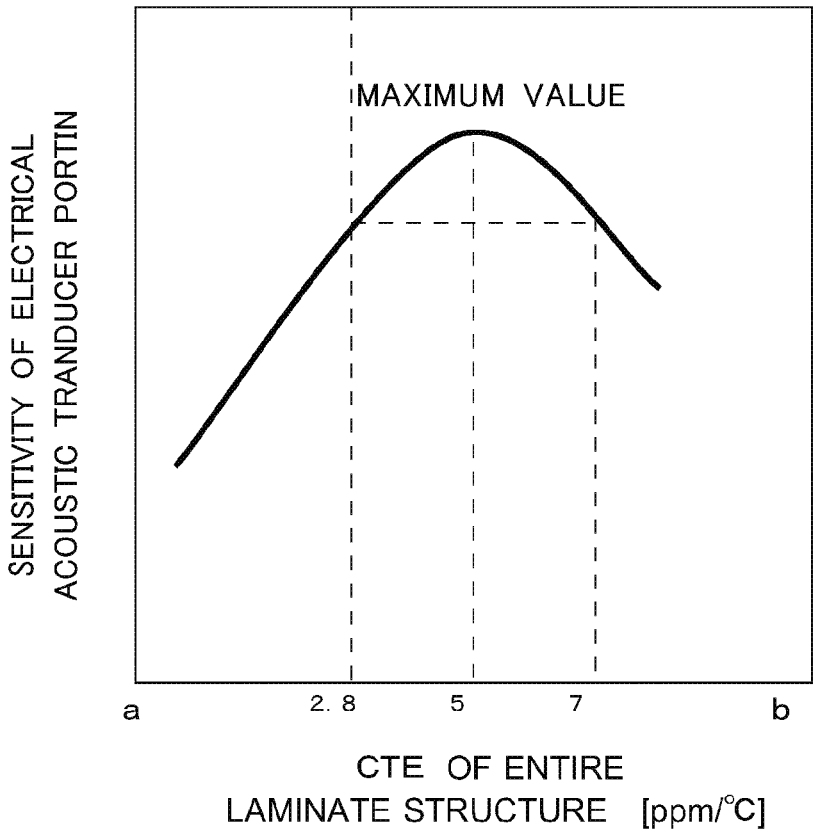
FIG. 9 is a graph showing a relationship between a coefficient of thermal expansion of a film base board, inclusive of a conductor pattern, and a sensitivity of an electrical acoustic transducer portion.

FIG. 9 is a graph showing a relationship between the coefficient of thermal expansion (CTE of the entire laminate structure) of the film base hoard 21, inclusive of the conductor pattern 25, and the sensitivity of the electrical acoustic transducer portion 22. It is represented that the maximum sensitivity value of the electrical acoustic transducer portion 22 is obtained at a point where the coefficient of thermal expansion of the entire laminate structure is slightly larger than the coefficient of thermal expansion of the silicon. It is as described above that, by suitably setting the thickness ratio ($\alpha$; see FIG. 7) of the conductor pattern 25 and matching the coefficient of thermal expansion of the film base board 21, inclusive of the conductor pattern 25, with the coefficient of thermal expansion of the silicon, it is possible to make the stress acting on the diaphragm 222 come close to 0. This means, in other words, that by deviating the thickness ratio of the conductor pattern 25 from $\alpha$, it is possible to intentionally control the tension of the diaphragm 222.

If the thickness ratio of the conductor pattern 25 becomes smaller than $\alpha$ in FIG. 7, the coefficient of thermal expansion of the film base hoard 21, inclusive of the conductor pattern 25, becomes smaller than the coefficient of thermal expansion of the diaphragm 222. In this case, the tensile-direction stress acts on the diaphragm 222 from the film base board 21. Because of this, the tension of the diaphragm 222 becomes large and the sensitivity becomes low. Accordingly, it is preferable to secure a coefficient of thermal expansion of the film base board 21, inclusive of the conductive pattern 25, that is at least 0.8 times or larger than the coefficient c of thermal expansion of the diaphragm 222.

Besides, from FIG. 9, it is preferable that, to secure a sensitivity equal to or larger than the sensitivity at the time the coefficient of thermal expansion of the film base board 21, inclusive of the conductor pattern 25, is equal to the coefficient (2.8 ppm/° C.) of thermal expansion of the diaphragm 222, the coefficient of thermal expansion of the film base board 21, inclusive of the conductor pattern 25, is set at 7 ppm/° C. (which is 2.5 times as large as the coefficient of thermal expansion of the diaphragm) or smaller. Especially, the sensitivity of the electrical acoustic transducer portion 22 is most susceptible to the influence of the electrically conductive pattern portion where the electrical acoustic transducer portion 22, including the diaphragm 222, is mounted, so that it is preferable that the design is performed such that the coefficient of thermal expansion in this region falls in the above range.

From the above description, it is understood that when the coefficient of thermal expansion of the film base board 21, inclusive of the conductor pattern 25, is in the range 0.8 to 2.5 times as large as the value of the coefficient c of thermal expansion of the diaphragm 222, it is possible to obtain a good sensitivity characteristic. In the meantime, by making the thickness ratio of the conductor pattern 25 larger than $\alpha$, the coefficient of thermal expansion of the entire laminate structure becomes large, so that it is possible to give the compression-direction stress to the diaphragm 222 and reduce the tension of the diaphragm 222. According to this, by making the displacement of the diaphragm 222 for an external sound pressure, it is possible to increase the sensitivity of the electrical acoustic transducer portion 22. Because of this, the maximum sensitivity value of the electrical acoustic transducer portion 22 is obtained at a point where the coefficient of thermal expansion of the entire laminate structure is slightly larger than the coefficient of thermal expansion of the silicon.

It is described that, in the above two-layer laminate structure, the conductor pattern 25 is formed on the entire surface of the film base board 21. However, there is a case where the conductor pattern 25 is formed on the film base board 21 by patterning. In this case, it is possible to use a value, which is obtained by m the thickness y of the conductor pattern 25 by the pattern formation area ratio r, as an effective thickness. In other words, the thickness ratio of the conductor pattern to the total thickness of the two-layer structure may be replaced by ry/(x+ry). An effective method for making the formation area ratio r of the conductor pattern is to employ a mesh structure. Especially in a case where a wide-area ground is disposed for the purpose of strengthening the ground as an electromagnetic noise measure, by employing the mesh structure it is possible to reduce the area ratio of the conductor pattern and obtain the same effect as reducing the conductor thickness.

Next, a case is examined where the coefficient of thermal expansion of the film base board 21 is equal to or larger than the coefficient of thermal expansion of the diaphragm 222; in other words, the following a relationship is satisfied: (the coefficient of thermal expansion of the diaphragm≤the coefficient of thermal expansion of the film base board<the coefficient of thermal expansion of the conductor pattern).

Figure 10:
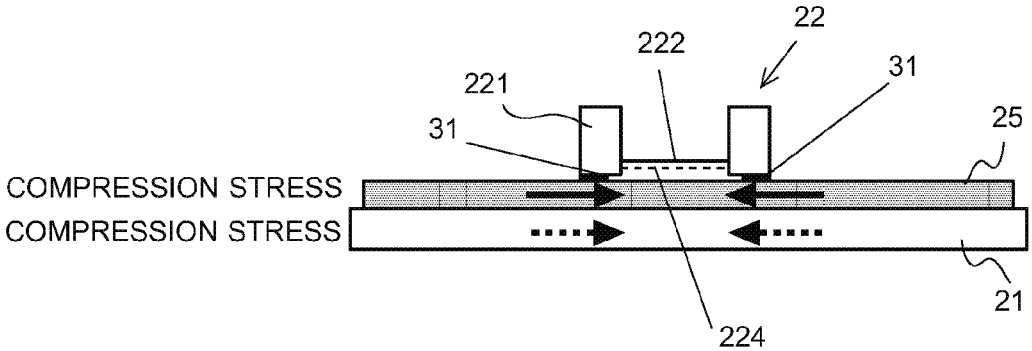
FIG. 10 is a vim for describing a stress acting on a diaphragm of a MEMS chip in a case where, in the models shown in FIG. 5A and FIG. 5B, the coefficient of thermal expansion of the film base board is larger than the coefficient of thermal expansion of the diaphragm.

To dispose the electrical acoustic transducer portion 22 onto the electrically conductive pattern 25 on the film base board 21 by flip chip mounting, solder paste is transferred to the electrically conductive pattern 25, to which the electrical acoustic transducer portion 22 is to be joined, by using a technique such as screen printing and the like; the electrical acoustic transducer portion 22 is mounted, and the film base board 21 on which the electrical acoustic transducer portion 22 is mounted undergoes the reflow process. In this case, during the cooling time after the heating time, the solder 31 sets near the solder inciting point, so that a positional relationship between the electrical acoustic transducer portion 22 and the electrically conductive pattern 25 is decided. When the solder 31 is in the melting state before setting, a stress does not act on the diaphragm 222. However, after the solder 31 sets during the cooling step, the film base board 21 is equal to or larger than the diaphragm 222 in shrink amount, while the electrically conductive pattern 25 is further larger than the diaphragm 222 in shrink amount. Because of this, which is caused by the difference in the coefficients of thermal expansion (as shown in FIG. 10) in both of the electrically conductive pattern 25 and the film base board 21, a compression-direction stress on the diaphragm 222 occurs. The larger the difference between the solder melting point and the room temperature is, the larger this stress becomes.

Here, FIG. 10 is a view for describing the stress acting on the diaphragm of the MEMS chip in a case where, in the models shown in FIG. 5A and FIG. 5B, the coefficient of thermal expansion of the film base board is larger than the coefficient of thermal expansion of the diaphragm.

Figure 11:
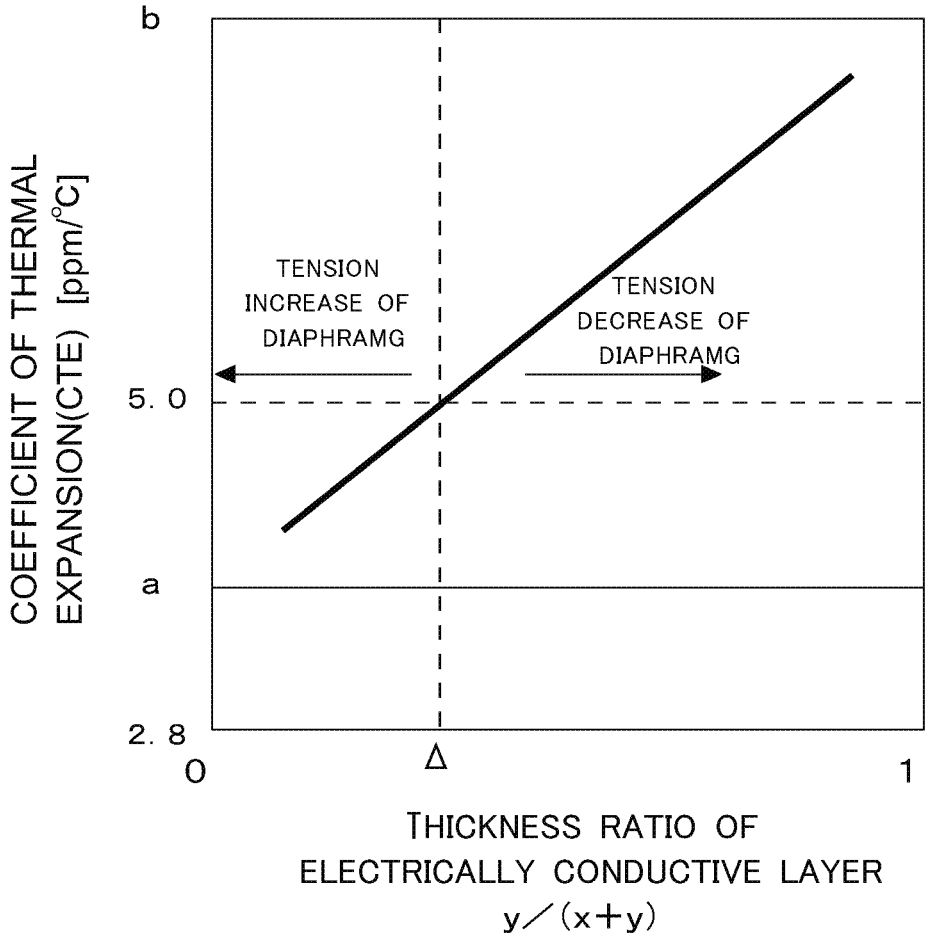
FIG. 11 is a graph showing a characteristic of a coefficient of thermal expansion of a film base board, inclusive of a conductor pattern.

Here, a case is examined where the film base board 21 on which the electrically conductive pattern 25 is formed has a two-layer laminate structure. The thickness of the film base board 21 is x, and the coefficient of thermal expansion of the film base board 21 is a. The thickness of the conductor pattern 25 is y, and the coefficient of thermal expansion of the conductor pattern 25 is b. The characteristic of the coefficient of thermal expansion of the film base board 21, inclusive of the conductor pattern 25, versus the thickness of the conductor pattern 25 is as shown in FIG. 11. A horizontal axis in FIG. 11 represents the thickness ratio (y/(x+y)) of the conductor layer (electrically conductive pattern) to the total thickness of the two-layer structure. The vertical axis represents the coefficient of thermal expansion of the two-layer structure.

In FIG. 11, it is represented that the coefficient of thermal expansion of the film base board 21, inclusive of the conductor pattern 25, changes in accordance with the thickness ratio between the conductor pattern 25 and the film base board 21. When the thickness ratio of the conductor pattern 25 is 0, the coefficient of thermal expansion=a, and when the thickness ratio of the conductor pattern 25 is 1, the coefficient of thermal expansion=b. Besides, on the vertical axis, the coefficient of thermal expansion of the silicon (2.8 ppm/° C.) is represented. And, it is understood that when the thickness ratio of the conductor pattern 25 is 0, the coefficient of thermal expansion of the film base board 21, inclusive of the conductor pattern 25, comes closest to the coefficient of thermal expansion of the silicon; and as the thickness ratio of the conductor pattern 25 increases, the coefficient of thermal expansion of the film base board 21 goes away from the coefficient of thermal expansion of the silicon.

Accordingly, to make the stress acting on the diaphragm 222 small, it is desirable that the thickness of the conductor pattern 25 is made as thin as possible and the pattern formation area ratio r is reduced. On the other hand, as described above, by making the coefficient of thermal expansion of the entire laminate structure larger than the coefficient of thermal expansion of the diaphragm 222, it is possible to give compression-direction stress to the diaphragm 222 and reduce the tension of the diaphragm 222. According to this, by making the displacement of the diaphragm 222 for an external sound pressure large, it is possible to increase the sensitivity of the electrical acoustic transducer portion 22. From an experimental result (see FIG. 9), by setting the coefficient of thermal expansion of the film base board 21, inclusive of the conductor pattern 25, at 2.8 ppm/° C. or larger and 7 ppm/° C. or smaller, it is possible to prevent a twist and a local bend from occurring in the diaphragm 222. Especially, the sensitivity of the electrical acoustic transducer portion 22 is most susceptible to the influence of the electrically conductive pattern portion where the electrical acoustic transducer portion 22, including the diaphragm 222, is mounted, so that it is preferable that the design is performed such that the coefficient of thermal expansion in this region falls in the above range. According to this, it becomes possible to make the diaphragm 222 vibrate in the normal vibration mode, and it is possible to achieve a microphone that has a high sensitivity and high reliability.

It is described that, in the above two-layer laminate structure, the conductor pattern 25 is formed on the entire surface of the film base board 21. However, there is a case where the conductor pattern 25 is formed on the film base board 21 by patterning. In this case, it is possible to use a value, which is obtained by multiplying the thickness y of the conductor pattern 25 by the pattern formation area ratio r, as an effective thickness. In other words, the thickness ratio of the conductor pattern to the total thickness of the two-layer structure may be replaced by ry/(x+ry). An effective method for making the formation area ratio r of the conductor pattern is to employ a mesh structure. Especially, in a case where a wide-area ground is disposed for the purpose of strengthening the ground as an electromagnetic noise measure, by employing the mesh structure, it is possible to reduce the area ratio of the conductor pattern and obtain the same effect as reducing the conductor thickness.

Here, back to FIG. 3A, the electrically conductive layer 15 formed on the upper surface of the film base board 11 of the microphone unit 1 includes a mesh-shaped electrically conductive pattern 153 disposed over a wide area of the film base board 11. This mesh-shaped electrically conductive pattern 153 has both of a function for the ground (GND) wiring of the film base board 11 and an electromagnetic shield function.

To obtain the electromagnetic shield function, it is preferable that the electrically conductive layer which functions as the GND wiring is formed over a wide area of the film base board 11; however, in a case where a GND wiring is continuously formed over a wide area, the coefficient of thermal expansion of the film base board 11, inclusive of the electrically conductive layer, becomes too large, in this case, the difference between the coefficient of thermal expansion of the film base board 11 and the coefficient of thermal expansion of the MEMS chip 12 becomes large, so that as described above, the stress easily acts on the diaphragm 122.

Because of this, in the present embodiment, the electrically conductive layer which functions as the GND wiring is formed into the mesh-shaped electrically conductive pattern 153. According to this, even if the electrically conductive layer is formed over a wide area, it is possible to reduce the percentage of the electrically conductive portion (metal portion). Because of this, it is possible to effectively obtain the electromagnetic shield effect while reducing the remaining stress that acts on the diaphragm.

Figure 12:
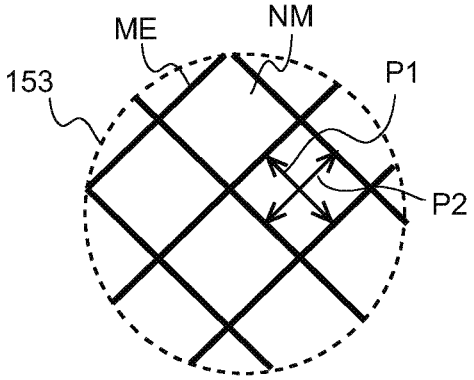
FIG. 12 is an enlarged view of a mesh-shaped electrically conductive pattern formed on a film base board of a microphone unit according to the present embodiment.

FIG. 12 is an enlarged view showing the mesh-shaped electrically conductive pattern 153 formed on the film base board 11 of the microphone unit 1 according to the present embodiment. As shown in FIG. 12, the mesh-shaped electrically conductive pattern 153 is obtained by forming a thin metal lines ME into a net shape. In the present embodiment, the thin metal lines ME are so formed as to intersect each other at right angles; the pitches P1, P2 between the metal thin lines ME are the same; and the shape of an opening portion NM is a square shape. The pitch P1 (P2) between the thin metal lines ME is designed to be about 0.1 mm, for example; and the ratio of the thin metal lines ME in the mesh structure is designed to be about 50% or smaller, for example.

Here, in the present embodiment, the thin metal lines ME are so structured as to intersect each other at right angles; however, this is not limiting, and the thin metal lines ME may be so structured as to Obliquely intersect each other. Besides, the pitches P1, P2 between the metal lines ME may not be invariably the same. Besides, it is preferable that the pitches P1, P2 between the thin metal lines ME are equal to or smaller than the diameter (in the present embodiment, about 0.5 mm) of the vibration portion of the diaphragm 122. This is employed to alleviate the change of the coefficient of thermal expansion of the surface of the film base board to reduce the remaining stress on the diaphragm 122 as much as possible. Besides, in the present embodiment, the thin metal lines are formed into the net shape to obtain the mesh structure; however, this is not limiting, and the mesh structure may be obtained by providing the continuous wide-area pattern with a plurality of through-holes that have substantially a circular shape when viewed from top.

Back again to FIG. 3A, the electrically conductive layer 15 formed on the upper surface of the film base board 11 includes: a first relay pad 154; a second relay pad 155; a third relay pad 156; a fourth relay pad 157; a first wiring 158; and a second wiring 159.

The first relay pad 154 is electrically connected via the first wiring 158 to the power-supply electricity input pad 152*c* for supplying power-supply electricity to the ASIC 13. The second relay pad 155 is electrically connected via the second wiring 159 to the output pad 152*d* for outputting the signal processed by the ASIC 13. The third relay pad 156 and the fourth relay pad 157 are directly electrically connected to the mesh-shaped electrically conductive pattern 153.

With reference to FIG. 3B, the electrically conductive layer 16 formed on the lower surface of the film base board 11 includes a first external connection pad 161, a second external connection pad 162, a third external connection pad 163, and a fourth external connection pad 164. The microphone unit 1 is mounted on a mount base board of a voice input apparatus, when these four external connection pads 161 to 164 are electrically connected to electrode pads and the like that are disposed on the mount base board.

The first external connection pad 161 is an electrode pad for supplying power-supply electricity to the microphone unit 1 from outside, and is electrically connected via a through-hole via (not shown) to the first relay pad 154 that is formed on the upper surface of the film base board 11. The second external connection pad 162 is an electrode pad for outputting the signal processed by the ASIC 13 to the outside of the microphone unit 1, and is electrically connected via a through-hole via not shown) to the second relay pad 155 that is formed on the upper surface of the film base board 11. Further, the third external connection pad 163 and the fourth external connection pad 164 are electrode pads for connecting to an external GND, and are electrically connected via through-hole vias (not shown) to the third relay pad 156 and the fourth relay pad 157, respectively, that are formed on the upper surface of the film base board 11.

Here, in the present embodiment, except for the mesh-shaped electrically conductive pattern 153, the electrically conductive layers 15, 16 are formed of a continuous pattern. However, depending on the case, other portions also may be formed into a mesh structure.

The strictures of the electrically conductive layers 15, 16 formed on the film base board 11 are as described above. By forming the electrically conductive layers 15, 16, the coefficient of thermal expansion of the film base board 11 becomes large compared with the case of the film base board 11 only. In this point, in light of the above influence which the electrically conductive pattern gives to the coefficient of thermal expansion of the film base board, it is preferable that the electrically conductive layers 15, 16 are formed such that the coefficient p of thermal expansion of the film base board 11, inclusive of the electrically conductive layers 15, 16, which is expressed by the following formula (3), falls in the range 0.8 to 2.5 times as large as the coefficient of thermal expansion of the diaphragm 122. In more detail, there are two cases, one of which is that the coefficient of thermal expansion of the film base board 11 is smaller than the coefficient of thermal expansion of the diaphragm 122, and the other of which is that the coefficient of thermal expansion of the film base board 11 is equal to or larger than the coefficient of thermal expansion of the diaphragm 122. In the former case, it is preferable that the electrically conductive layers 15, 16 are formed such that the coefficient β of thermal expansion falls in the range 0.8 to 2.5 times as large as the coefficient of thermal expansion of the diaphragm 122. In the latter case, it is preferable that the electrically conductive layers 15, 16 are formed such that the coefficient β of thermal expansion falls in the range more than 1.0 to 2.5 times as large as the coefficient of thermal expansion of the diaphragm 122. According to this, it is possible to reduce the remaining stress acting on the diaphragm 122 and produce a microphone unit that has a good mike characteristic.

$$\beta=(ax+bry)/(x+ry) \tag{3}$$

where a: the coefficient of thermal expansion of the film base board
b: the coefficient of thermal expansion of the electrically conductive layer
x: the thickness of the film base board
y: the thickness of the electrically conductive layer
r: the pattern formation area ratio of the electrically conductive layer Here, in the case of the present embodiment where the electrically conductive layer is formed on both surfaces of the film base board 11, it is sufficient to calculate the pattern formation area ratio r considering, for example, as if the electrically conductive layer 16 formed on the lower surface is formed on the upper surface (the seeming percentage of the electrically conductive layer on the upper surface increases).

If the thickness of the electrically conductive layers 15, 16 are too large, the coefficient of thermal expansion easily becomes large. Accordingly, it is preferable that the electrically conductive layers 15, 16 are formed thin. In the case where the coefficient of thermal expansion of the film base board 11 is equal to or larger than the coefficient of thermal expansion of the diaphragm 122, it is preferable, for example, that the thickness of the electrically conductive layers 15, 16 is one-fifth or smaller of the thickness of the film base board 11. Besides, the electrically conductive layers 15, 16 may be so structured as to include a plated layer. However, it is preferable that the plated layer also is formed thin, and it is preferable that the thickness of the electrically conductive layers 15, 16, inclusive of the plated layer, is so formed as to be one-fifth or smaller of the thickness of the film base board 11.

Here, the reason that the coefficient β of thermal expansion of the film base board 11, inclusive of the electrically conductive layers 15, 16, is expressed by the formula (3) is described. In the microphone unit 1 according to the present embodiment, there are portions where the conductors (the electrically conductive portions of the electrically conductive layers 15, 16) are formed on the base hoard surface of the film base board 11, and portions (inclusive of the opening portion of the mesh structure) where the conductors are not formed. Because of this, it is considered as if a conductor—which has the thickness (iv) that is obtained by multiplying the thickness y of the electrically conductive layers 15, 16 by the percentage (which is the above r) of the conductor on the film base board 11—is formed on the entire base board surface on one side of the film base board 11.

When considering, as described above, the case where the coefficient of thermal expansion of the film base board 11, inclusive of the electrically conductive layers 15, 16 is β, the following formula (4) is satisfied.

$$\beta(x+ry)=ax+bry \tag{4}$$

This formula (4) is varied to obtain the above formula (3).

Here, in the present embodiment, the wiring (conductor) which electrically connects the output pad 151*a* for outputting the electrical signal generated by the MEMS chip 12 and the input pad 152*a* of the ASIC 13 to each other is formed in the inside of the film base board 11. Because of this, it is also possible to include this conductor into the electrically conductive layer. However, with regard to the coefficient of thermal expansion of the film base board 11, inclusive of the electrically conductive layers 15, 16, the coefficient of thermal expansion of the electrically conductive pattern on the lower portion of the MEMS chip 12 considerably influences the MEMS chip 12, so that the structure of the electrically conductive layer and the value r in the formula (3) may be decided focusing on only a region that is near the MEMS chip 12. (In one case, only the pattern region where the MEMS chip 12 is mounted is considered; in another case, a region slightly wider than the pattern region is considered.)

The above-described embodiments are examples. The microphone unit according to the present invention is not limited to the structures of the above-described embodiments. In other words, various modifications may be applied to the structures of the above-described embodiments within the scope that does not depart from the object of the present invention.

Figure 13:
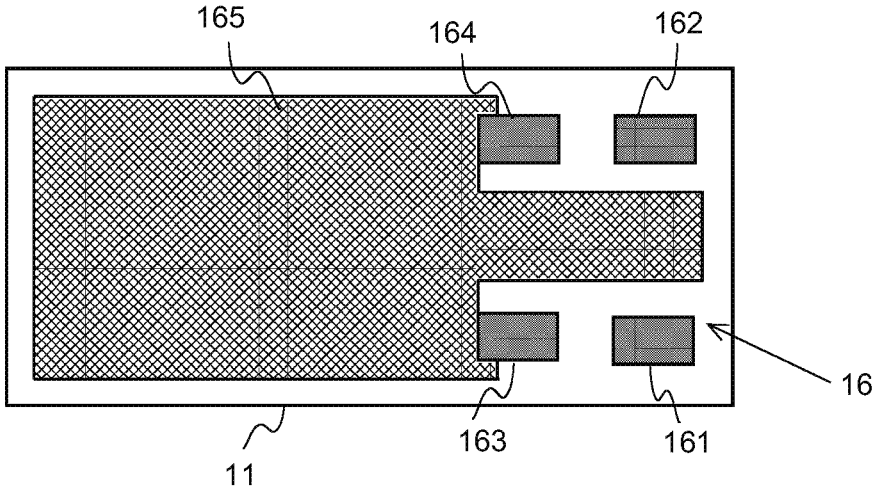
FIG. 13 is a view for describing a variation of the present embodiment.

For example, in the above-described embodiments, a structure is employed in which the mesh-shaped electrically conductive pattern 153 having the GND wiring function and the electromagnetic shield function is formed on only the upper surface of the film base board 11. However, this structure is not limiting: a structure may be employed in which the mesh-shaped electrically conductive pattern having the above functions is formed on only the lower surface of the film base board 11, or a structure may be employed in which the mesh-shaped electrically conductive pattern having the above functions is formed on both the upper surface and the lower surface of the film base board 11. By forming mesh-shaped electrically conductive patterns that have substantially the same shape and the same percentage on both surfaces of the film base board 11, it is possible to reduce an imbalance between the portions where the electrically conductive layers are formed and to alleviate a warp of the film base board 11. FIG. 13 shows a structure of the lower surface of the film base board 11 in the case where the mesh-shaped electrically conductive pattern is formed on both surfaces of the film base board 11 (a reference number 165 indicates the mesh-shaped electrically conductive pattern).

Figure 14:
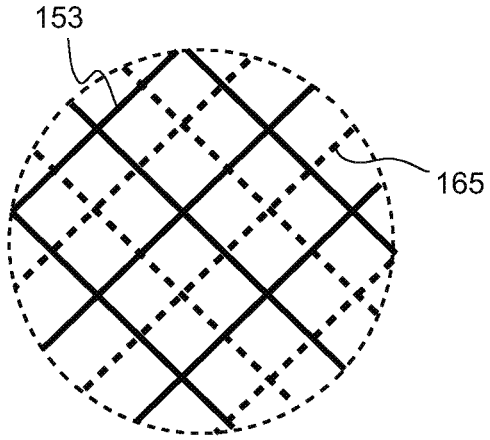
FIG. 14 is a view for describing a variation of the present embodiment.

And as shown in FIG. 14, in the case where the mesh-shaped electrically conductive pattern is formed on both surfaces of the film base board 11, it is preferable that the mesh-shaped electrically conductive pattern 153 (the pattern which the thin metal lines are represented by solid lines) on the upper surface and the mesh-shaped electrically conductive pattern 165 (the pattern in which the thin metal lines are represented by broken lines) on the lower surface are so formed as to deviate from each other with respect to the positioning of the thin metal lines. According to this structure, it is possible to substantially narrow the distance (pitch) between the meshes while forming the mesh-shaped electrically conductive pattern over a wide area. Because of this, it is possible to increase the electromagnetic shield effect while alleviating the coefficient of thermal expansion of the film base board, inclusive of the electrically conductive layer, changing from the case of the film base board only.

Figure 15:
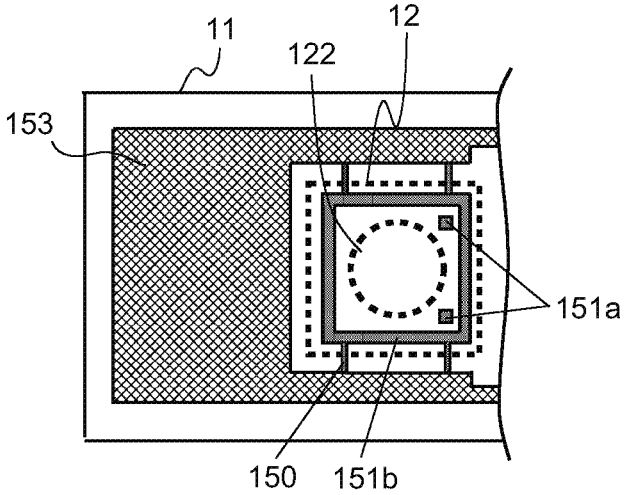
FIG. 15 is a view for describing a variation of the present embodiment.

Besides, in the present embodiments, a structure is employed in which the junction pad 151*b* for joining the MEMS chip 12 and the mesh-shaped electrically conductive pattern 153 are directly electrically connected to each other. However, this structure is not intended to be limiting. In other words, as shown in FIG. 15, a structure may be employed in which the mesh-shaped electrically conductive pattern 153 is not disposed right under the MEMS chip 12 (i.e., a structure in which the mesh-shaped electrically conductive pattern 153 and the MEMS chip 12 do not overlap with each other when viewed from top), and the mesh-shaped electrically conductive pattern 153 and the junction pad 151*b* are connected to each other by a connection pattern 150.

As described above, by employing the structure in which the mesh-shaped electrically conductive pattern 153 is not disposed right under the MEMS chip 12, it is possible to reduce the remaining stress acting on the diaphragm 122 of the MEMS chip 12. Here, in the case where the electrically conductive layer is also formed on the lower surface of the film base board 11, it is preferable that this electrically conductive layer and the MEMS chip 12 are so formed as not to overlap with each other, when viewed from top.

It is preferable that the above junction pattern 150 is formed as thin (thin line) as possible to reduce the remaining stress that acts on the diaphragm 122. For example, it is preferable that the line width is equal to or smaller than 100 μm.

Besides, in the above description, it is described that the present invention is applied to the microphone unit 1 in which the sound pressure acts on the diaphragm 122 of the MEMS chip 12 from one direction. However, the present invention is not limited to this. For example, the present invention is applicable to a differential microphone unit in which the sound pressures act on both surfaces of the diaphragm 122 and the diaphragm vibrates in accordance with a sound pressure difference.

Figure 16A:
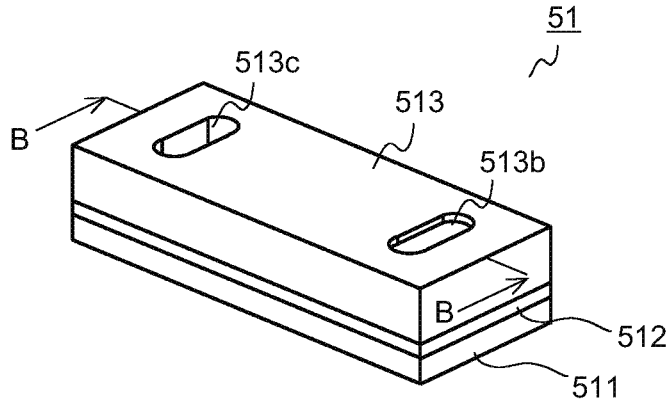
FIG. 16A is a schematic perspective view showing another embodiment of a microphone unit to which the present invention is applied.
Figure 16B:
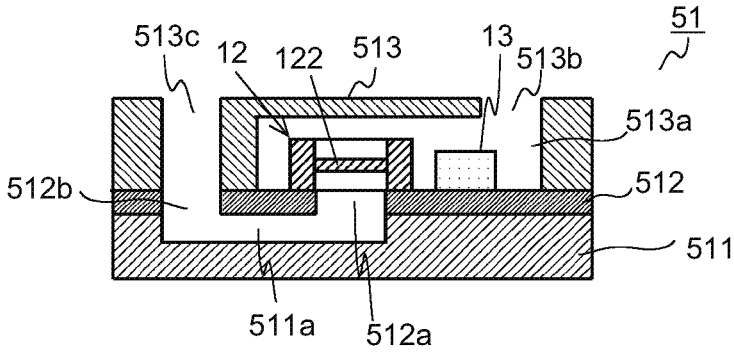
FIG. 16B is a schematic sectional view along an B-B position in FIG. 16A.

An exemplary structure of a differential microphone unit to which the present invention is applicable is described with reference to FIG. 16A and FIG. 16B. FIG. 16A and FIG. 16B are views showing an exemplary structure of a differential microphone unit to which the present invention is applicable, of which FIG. 16A is a schematic perspective view showing the structure and FIG. 16B is a schematic sectional view along the section B-B shown in FIG. 16A. As shown in FIG. 16A and FIG. 16B, a differential microphone 51 includes a first base board 511, a second base board 512; and a lid portion 513.

The first base board 511 is provided with a groove portion 511*a*. The second base board 512 on which the MEMS chip 12 and the ASIC 13 are mounted has a first through-hole 512*a* that is formed under the diaphragm 122 and connects the diaphragm 122 to the groove portion 511*a* and a second through-hole 512*b* that is disposed at a portion over the groove portion 511*a*. The lid portion 513, which is placed over the second base board 512, is provided with: an internal space 513*a* that forms a space to enclose the MEMS chip 12 and the ASIC 13; a third through-hole 513*b* that extends from the internal space 513*a* to the outside; and a fourth though-hole 513*c* that connects to the second through-hole 512*b*.

According to this, a sound occurring outside of the microphone unit 51 successively passes through the third through-hole 513*b* and the internal space 513*a* to reach the upper surface of the diaphragm 122. In addition, the sound successively passes through the fourth through-hole 513*c*, the second through-hole 512*b*, the groove portion 511*a*, and the first through-hole 512*a* to reach the lower surface of the diaphragm 122. In other words, the sound pressures act on both surfaces of the diaphragm 122.

Besides, in the above-described embodiments, copper is described as an example for the electrically conductive pattern. However, a laminate metal structure of, for example, copper, nickel, and gold is often used as the electrically conductive pattern. Accordingly, the electrically conductive layer may be formed into a laminate metal structure. The coefficient of thermal expansion of copper is 16.8 ppm/° C., the coefficient of thermal expansion of nickel is 12.8 ppm/° C., and the coefficient of thermal expansion of gold is 14.3 ppm/° C. Although there is a slight difference, these are large values compared with silicon. It is possible to approximately calculate the coefficient of thermal expansion of the entire laminate metal as an average value considering the respective thickness ratios.

Figure 17:
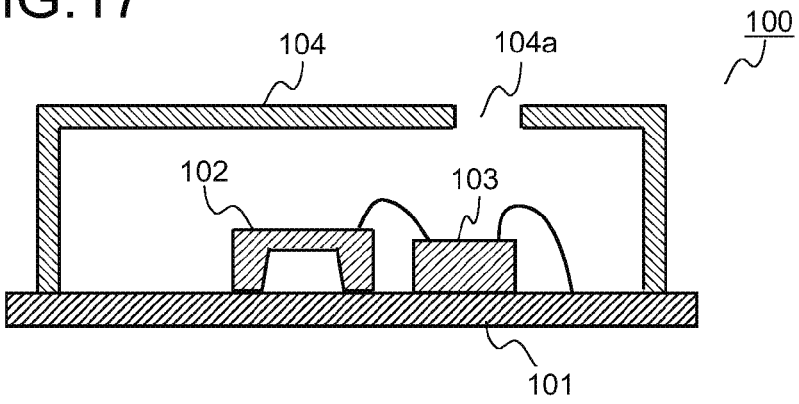
FIG. 17 is a schematic sectional view showing a structure of a conventional microphone unit.
Figure 18:
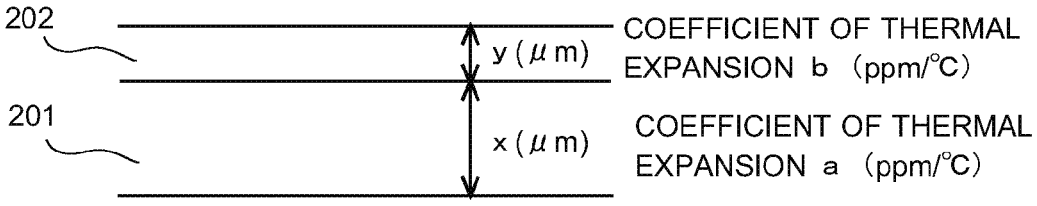
FIG. 18 is a view for describing a conventional problem in a case where an electrically conductive layer is formed by patterning over a wide area of a film base board.

Besides, in the above-described embodiments, a structure is employed in which the MEMS chip 12 and the ASIC 13 are disposed by the flip chip mounting technique. However, the application range of the present invention is not limited to this. For example, like the conventional structure shown in FIG. 17, the present invention is also applicable to a microphone unit in which the MEMS chip and the ASIC are disposed by die bonding and wire bonding technologies.

Here, in the case where the above-mentioned die bonding and wire bonding technologies are used, it is possible to fix the MEMS chip 12 and the like to the film base board 11 by an adhesive at low temperature. Because of this, it is possible to alleviate the remaining stress that acts on the MEMS chip 12 due to a difference between the coefficient of thermal expansion of the film base board 11 where the electrically conductive layers 15, 16 are disposed and the coefficient of thermal expansion of the MEMS chip 12. From such point, it is possible to say that the present invention is more suitably applicable to the microphone unit that has the structure in which the MEMS chip 12 is disposed on the film base board 11 by flip chip mounting.

Besides, in the above-described embodiments, the MEMS chip 12 and the ASIC 13 are composed of chips independent of each other. However, a structure may be employed in which the integrated circuit incorporated in the ASIC 13 is monolithically formed on the silicon substrate on which the MEMS chip 12 is formed.

Besides, in the above-described embodiments, the structure is employed in which the electrical acoustic transducer portion for transducing the sound pressure into the electrical signal is the MEMS chip 12 that is formed by using semiconductor production technology. However, this structure is not limiting. For example, the electrical acoustic transducer portion may be a capacitor-type microphone and the like that use an electret film.

Besides, in the above embodiments, the so-called "capacitor-type" microphone is employed as the structure of the electrical acoustic transducer portion (which is the MEMS chip 12 according to the present embodiment) of the microphone unit 1. However, the present invention is also applicable to a microphone unit that employs a structure other than the capacitor-type microphone. For example, the present invention is also applicable to a microphone unit in which a microphone of an electrodynamic type (dynamic type), an electromagnetic type (magnetic type), or a piezoelectric type, and the like, is employed.

Besides, the shape of the microphone unit is not limited to the shapes according to the present embodiments. Of course, the shape of the microphone unit can be is modified to take on various shapes.

INDUSTRIAL APPLICABILITY

The microphone unit according to the present invention is suitable for voice communication apparatuses, such as for example, a mobile phone, a transceiver, and the like; voice process systems (voice identification system, voice recognition system, command generation system, electronic dictionary, translation apparatus, a voice input type of remote controller, and the like) that employ a technology for analyzing an input voice; recording apparatuses; amplification systems (loud speakers); and mike systems, and the like.

REFERENCE SIGNS LIST

1, 51 microphone units
11 film base board
12 MEMS chip (electrical acoustic transducer portion)
15, 16 electrically conductive layers
122 diaphragm
153, 165 mesh-shaped electrically conductive patterns

We claim:

1. A microphone unit comprising:
a base board;
an electrically conductive layer formed on a first surface of the base board; and
a transducer that is mounted on the base board, includes a diaphragm, and transduces a sound pressure into an electrical signal,
wherein a coefficient of thermal expansion of the diaphragm is larger than a coefficient of thermal expansion of the base board and is smaller than a coefficient of thermal expansion of the electrically conductive layer, and
a coefficient β of thermal expansion of the combination of the base board and the electrically conductive layer given by the following formula is in a range 0.8 to 2.5 times as large as the coefficient of thermal expansion of the diaphragm:

$$\beta=(ax+bry)/(x+ry),$$

where:
a is the coefficient of thermal expansion of the base board,
b is the coefficient of thermal expansion of the electrically conductive layer,
x is a thickness of the base board,
y is a thickness of the electrically conductive layer, and
r is a formation area ratio of the electrically conductive layer.

2. The microphone unit according to claim 1, wherein the electrically conductive layer is a mesh-shaped electrically conductive layer.

3. The microphone unit according to claim 2, wherein the mesh-shaped electrically conductive layer has a structure in which a metal thin line is formed into a net shape.

4. The microphone unit according to claim 3, wherein a ratio of the metal thin line is 50% or smaller in a region where the mesh-shaped electrically conductive layer is formed.

5. The microphone unit according to claim 3, wherein:
the mesh-shaped electrically conductive layer is further formed on a second surface opposite to the first surface of the base board; and
the metal thin line of the mesh-shaped electrically conductive layer formed on the first surface and the metal thin line of the mesh-shaped electrically conductive layer formed on the second surface are deviated from each other in position when viewed from a direction perpendicular to the first surface and the second surface.

6. The microphone unit according to claim 2, wherein a connection pad for securing electric connection with a component mounted on the base board is formed on the first surface separately from the mesh-shaped electrically conductive layer.

7. The microphone unit according to claim 1, wherein the electrically conductive layer is formed on a region that does not overlap a region where the transducer is disposed.

8. The microphone unit according to claim 7, wherein the electrically conductive layer is further formed on at least a portion of a region that overlaps the region where the transducer is disposed.

9. The microphone unit according to claim 1, wherein the first surface is a surface where the transducer is disposed.

10. The microphone unit according to claim 1, wherein the electrically conductive layer is a wiring pattern for ground connection.

11. The microphone unit according to claim 1, wherein the electrically conductive layer is formed on a wide area of the first surface.

12. The microphone unit according to claim 1, wherein the electrically conductive layer is further formed on the second surface opposite to the first surface of the base board.

13. The microphone unit according to claim 1, wherein the base board is composed of a film.

14. The microphone unit according to claim 1, wherein the transducer is disposed on the base board by flip chip mounting.

15. A microphone unit comprising:

a base board;

an electrically conductive layer formed on a first surface of the base board; and a transducer that is mounted on the base board, includes a diaphragm, and transduces a sound pressure into an electrical signal, wherein a coefficient of thermal expansion of the diaphragm is larger than a coefficient of thermal expansion of the base board and is smaller than a coefficient of thermal expansion of the electrically conductive layer, the electrically conductive layer is a mesh-shaped electrically conductive layer that has a structure in which a metal thin line is formed into a net shape, the mesh-shaped electrically layer is further formed on a second surface opposite to the first surface of the base board, and the metal thin line of the mesh-shaped electrically conductive layer formed on the first surface and the metal thin line of the mesh-like electrically conductive layer formed on the second surface are deviated from each other in position when viewed from a direction perpendicular to the first surface and the second surface.

* * * * *